US008261847B2

(12) United States Patent
Ford et al.

(10) Patent No.: US 8,261,847 B2
(45) Date of Patent: Sep. 11, 2012

(54) AUTOMATIC LOW POWER CONSUMPTION MODE FOR COMBUSTION TOOLS

(75) Inventors: Jeffry C. Ford, Zion, IL (US); Clayton O. Henry, North Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 343 days.

(21) Appl. No.: 12/576,949

(22) Filed: Oct. 9, 2009

(65) Prior Publication Data

US 2011/0084109 A1 Apr. 14, 2011

(51) Int. Cl.
*B25C 1/08* (2006.01)

(52) U.S. Cl. ..... 173/1; 227/2; 227/9

(58) Field of Classification Search ..... 227/2, 9; 173/1

See application file for complete search history.

(56) References Cited

U.S. PATENT DOCUMENTS

| | | | | |
|---|---|---|---|---|
| 4,403,722 | A | 9/1983 | Nikolich | |
| 4,483,473 | A | 11/1984 | Wagdy | |
| 4,483,474 | A | 11/1984 | Nikolich | |
| 4,522,162 | A | 6/1985 | Nikolich | |
| 4,535,289 | A * | 8/1985 | Abe et al. | 324/207.14 |
| RE32,452 | E | 7/1987 | Nikolich | |
| 4,808,934 | A * | 2/1989 | Yokoyama et al. | 324/207.25 |
| 5,133,329 | A | 7/1992 | Rodseth et al. | |
| 5,197,646 | A | 3/1993 | Nikolich | |
| 5,263,439 | A | 11/1993 | Doherty et al. | |
| 5,415,136 | A | 5/1995 | Doherty et al. | |
| 5,713,313 | A | 2/1998 | Berry | |
| 6,012,622 | A | 1/2000 | Weinger et al. | |
| 6,213,370 | B1 | 4/2001 | Walter | |
| 6,581,815 | B1 | 6/2003 | Ho et al. | |
| 6,739,490 | B1 * | 5/2004 | Shkolnikov et al. | 227/2 |
| 6,783,045 | B2 | 8/2004 | Shima et al. | |
| 7,108,164 | B2 | 9/2006 | Shima et al. | |
| 7,163,134 | B2 | 1/2007 | Moeller et al. | |

(Continued)

FOREIGN PATENT DOCUMENTS

DE 102004046000 A1 * 3/2006

(Continued)

OTHER PUBLICATIONS

International Search Report and the Written Opinion of the International Searching Authority issued on Jan. 28, 2011, in connection with corresponding PCT/US2010/050518.

*Primary Examiner* — Brian D Nash
(74) *Attorney, Agent, or Firm* — Levenfeld Pearlstein, LLC

(57) ABSTRACT

A combustion tool having a circuit for conserving battery power includes a battery assembly to power at least a portion of the combustion tool, a control circuit to place the combustion tool in an active mode or a low power consumption mode, and a motion sensing circuit to indicate a movement of the combustion tool and to indicate a non-movement of the combustion tool. A timer is set when a movement is detected and resets each time a new movement is sensed. If a new movement is not sensed when a predetermined amount of time has elapsed, the combustion tool enters into a low power consumption mode. The movement may be a vibration or a tilt movement. The motion sensing circuit enables the tool to be actuated without any unnecessary priming when motion is sensed and only minimal current is consumed when motion is not sensed, conserving battery power.

11 Claims, 3 Drawing Sheets

U.S. PATENT DOCUMENTS

| | | | | |
|---|---|---|---|---|
| 7,303,105 | B2 | 12/2007 | Dion et al. | |
| 7,306,052 | B2 | 12/2007 | Vahabi-Nejad et al. | |
| 2004/0045997 | A1* | 3/2004 | Birk et al. | 227/2 |
| 2004/0180754 | A1* | 9/2004 | Kitagawa et al. | 477/110 |
| 2006/0102111 | A1* | 5/2006 | Ohmori et al. | 123/46 H |
| 2007/0108249 | A1 | 5/2007 | Moeller | |
| 2007/0215664 | A1* | 9/2007 | Moeller et al. | 227/2 |
| 2008/0017689 | A1* | 1/2008 | Simonelli et al. | 227/132 |
| 2008/0210734 | A1* | 9/2008 | Uejima et al. | 227/2 |
| 2008/0223895 | A1* | 9/2008 | Fujisawa | 227/2 |
| 2008/0251559 | A1* | 10/2008 | Uejima et al. | 227/3 |

FOREIGN PATENT DOCUMENTS

| | | | |
|---|---|---|---|
| EP | 0642892 | A1 | 3/1995 |

* cited by examiner

AUTOMATIC LOW POWER CONSUMPTION MODE FOR COMBUSTION TOOLS

BACKGROUND OF THE INVENTION

The present invention relates generally to combustion tools and in particular to a device and a method for conserving battery power in combustion tools.

Combustion tools are known in the art for use in driving fasteners into workpieces, examples of which are described in Nikolich, U.S. Pat. Re. No. 32,452, and U.S. Pat. Nos. 4,522,162; 4,483,473; 4,483,474; 4,403,722; 5,197,646; 5,263,439 and 5,713,313, commonly assigned and incorporated by reference herein. Similar combustion-powered nail and staple driving tools are available commercially from ITW-Paslode of Vernon Hills, Ill. under the IMPULSE®, PASLODE®, and DUO-FAST® brands.

Combustion tools incorporate battery-powered elements, such as igniters, fans, and indicator lights. These battery-powered elements are driven by power supplied by an onboard battery and, to prolong battery life, it is common practice to remove the battery completely from the tool housing while the tool is not in use. While removing the battery is effective in prolonging battery life, users often forget to remove the battery. In these situations, the tool remains on and the battery is drained of power by such ancillary items as battery switches, indicator lights, and/or LEDs, which are typically configured to show the user that the tool is on, operational, functional, or has power.

Current solutions to the issue of battery power drainage include using sleep mode circuits within the tool. These sleep-mode circuits, which commonly use mechanical switches, place the tool in a sleep mode after a defined period of time. Mechanical switches, however, are subject to corrosion and wear, as well as shock and vibration, or fretting corrosion, reducing the long term effectiveness of such switches and sleep mode circuits. In addition, often it is necessary to "prime" the tool (for example, press a trigger or press the nose of the tool to a substrate) in order to wake up the tool from the sleep mode prior to the tool being useful for subsequent actuation or operation.

Accordingly, there is a need for a solution to battery drainage that minimizes battery consumption to prolong performance and battery life while allowing quick and timely actuation of the device when necessary.

BRIEF SUMMARY OF THE INVENTION

A combustion tool having a circuit for conserving battery power includes a battery assembly to power at least a portion of the combustion tool, a control circuit to place the combustion tool in an active mode or a low power consumption mode, and a motion sensing circuit to indicate a movement and a non-movement of the combustion tool. The motion sensing circuit communicates with the control circuit to indicate the movement of the combustion tool and the non-movement of the combustion tool. The control circuit places the combustion tool in the active mode upon the movement of the combustion tool and places the combustion tool in the low power consumption mode after a period of time after the non-movement of the combustion tool.

The motion sensing circuit receives power from the battery during low power consumption mode in order to operate. Each time the motion sensing circuit senses a movement of the tool, such as a vibration or tilt, the timer resets. The timer sets for a predetermined period of time, and when the time elapses, if no further movement is detected by the motion sensor, the control circuit places the tool in a low power consumption mode. As used herein, the terms vibration and tilt also include all linear and arced movements.

In a present method, a physical motion or movement of the tool is detected by the motion sensing circuit. A low resistance path between the battery assembly and the control circuit is maintained for the period of time determined by a timer circuit. If motion is no longer detected by the sensing device, and after the timer times out, a semiconductor device is driven into a low power consumption mode; thus, battery power is conserved.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
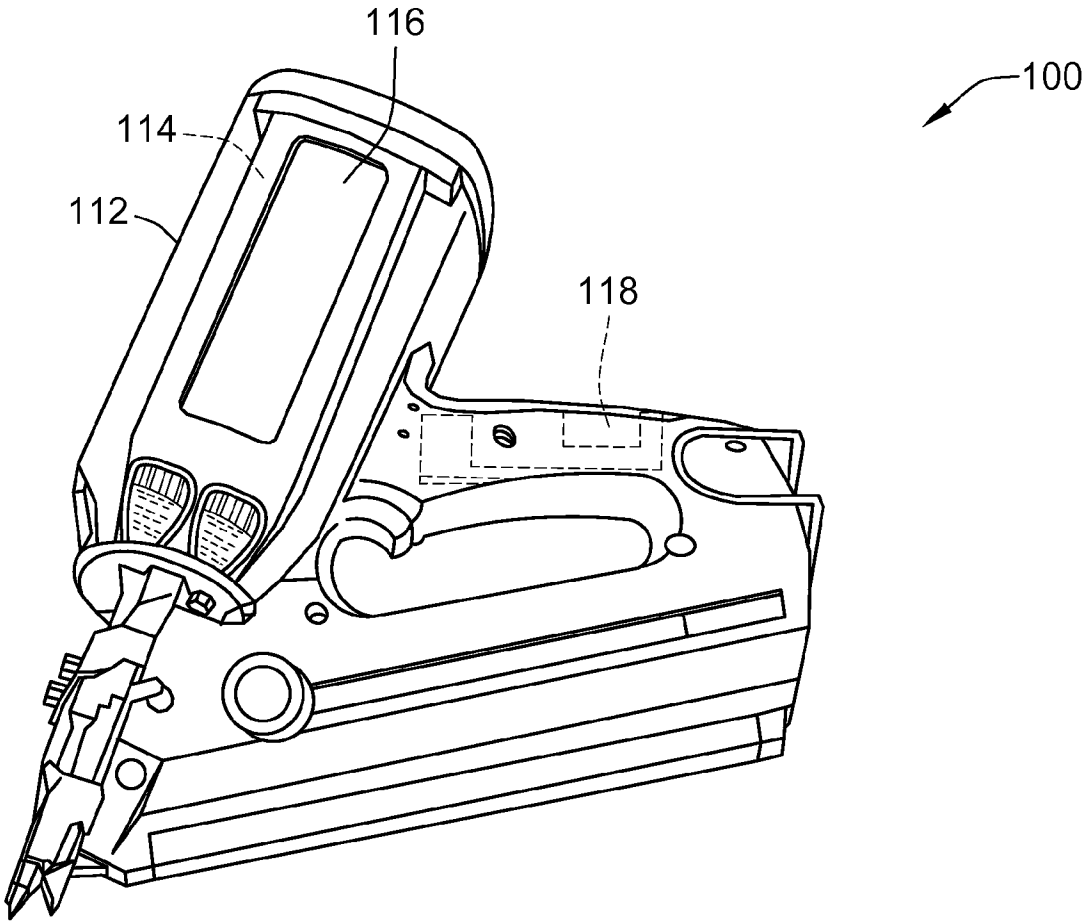
FIG. 1 is an embodiment of an exemplary power combustion tool.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

The present combustion tool and power management method and system uses a motion sensing circuit, a control circuit, and a timer circuit to detect movement of the combustion tool. The movement signals the combustion tool to "wake up" from a low power consumption mode. The control circuit and system operates in at least two modes: an "on" or active mode and a low power consumption mode. It will be appreciated and understood that the combustion tool may also be configured with an "off" mode, such as when the battery is removed or when the tool is turned off completely. In the present disclosure, reduced power consumption state, reduced power consumption mode, sleep mode, and standby mode will be used interchangeably.

In an embodiment, the motion sensing circuit relays a signal to a control circuit, which turns on or activates a semiconductor device or switch to allow operation of the tool. Once a pre-determined time period has elapsed, the control circuit turns the tool off, such that the tool enters the low power consumption mode. The battery in low power consumption mode minimally powers components such as the motion sensing circuit and the timer device, thus, prolonging battery life by preventing battery drainage by ancillary components. For example, in the low power consumption mode, the battery is not drained by powering, for example, items such as indicator lights or optical switches. A signal can be analog, digital, electronic or other type of communication signal.

Referring now to FIGS. 1-5, a combustion tool, in this example a combustion nailer (hereafter "tool"), incorporating a circuit to conserve battery power is generally designated 100. A housing 112 of the tool 100 encloses battery assembly 114 within a housing main chamber 116. As in conventional combustion tools, the combustion engine (not shown) includes a battery-powered high voltage control circuit 118, also known as an electronic power distribution unit or electronic sending unit, producing the spark for ignition. In the tool's active mode, the battery assembly supplies power to the control circuit, as well as to indicator lights, and other ancillary devices. In general, a battery assembly includes a battery as well as associated packaging and mechanisms for operation and maintenance thereof, such as, for example, protection circuits.

Figure 2:
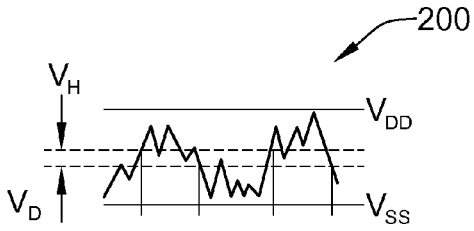
FIG. 2 illustrates a raw motion sensing circuit signal from a motion sensing circuit.

In one embodiment of the present invention, the control circuit enables the tool 100 to enter a low power management mode without the user having to remove the battery or actively turn off the tool 100. When the tool is moved (e.g., tilted or vibrated), a motion sensing circuit transforms the physical movement (e.g., tilting or vibrating) into an analog signal 200, as shown in FIG. 2. It is important to note that priming, such as pulling of the trigger or pressing the head of the tool against a substrate, is unnecessary to initiate the active mode. Simply picking up the tool or vibrating the tool or other small motion can cause the motion sensor to initiate an active mode. In this manner, the tool is immediately available for use and need not be "primed".

Figure 3:
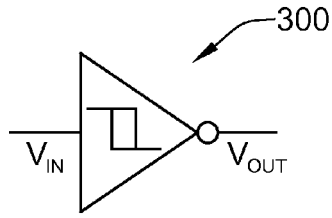
FIG. 3 is a waveform generating circuit.
Figure 4:
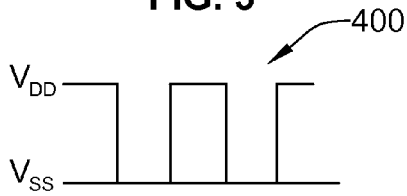
FIG. 4 is a digitized version of the motion sensing circuit signal.

The analog signal 200 is converted into a digital signal by a waveform generating circuit 300, such as a Schmitt trigger, as shown in FIG. 3. The digital signal 400, as shown in FIG. 4, can then be used to activate a switch, such as a head or trigger switch, to allow operation of the tool.

Figure 5:
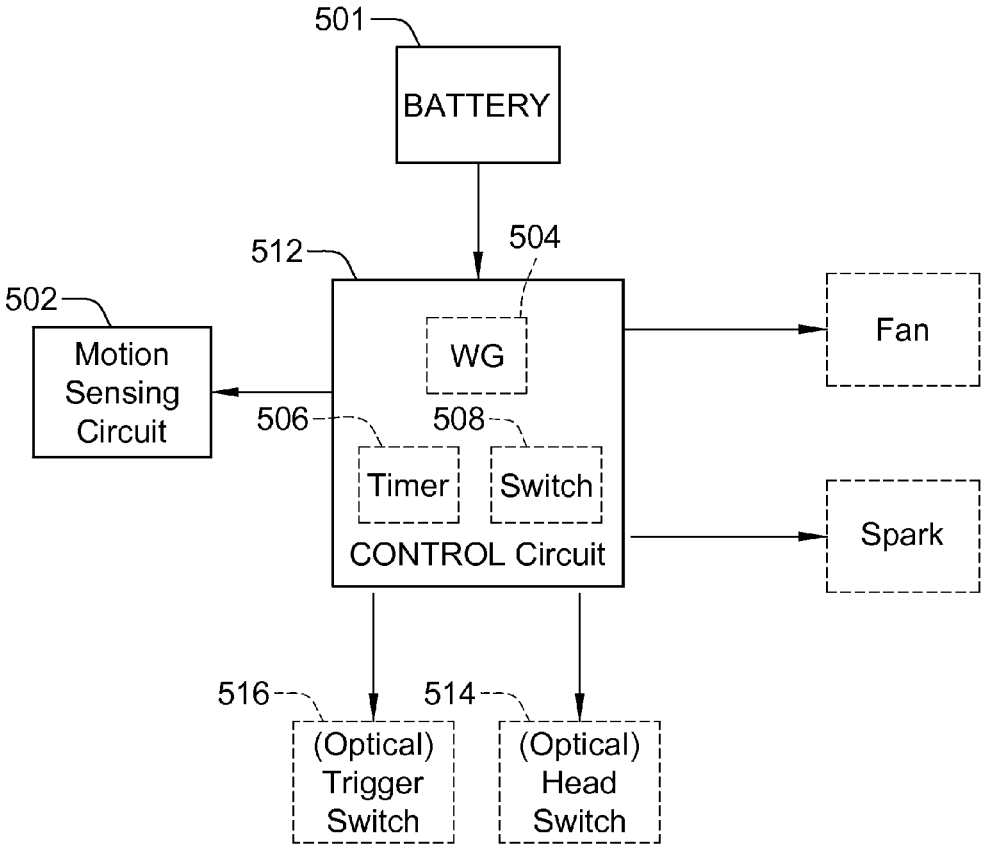
FIG. 5 is a block diagram of the present system in accordance with the principles of the present invention.

A block diagram of the present power management system 500 is shown in FIG. 5. As discussed above, when the tool is in motion, the sensing circuit 502 will generate a noise signal, such as that shown in FIG. 2. The signal is fed into a control circuit 512. The control circuit includes, in a present example, a waveform generating circuit 504, (for example, a Schmitt trigger) for signal conditioning, a timer circuit 506, and a semiconductor device or switch 508. The waveform generating circuit 504 is used to shape the signal into usable information (for example, a digital voltage signal). The digital signal is used to "wake up" the tool's control circuit 512 for a period of time. The control circuit 512 is programmed to reset the timer circuit 506 each time the sensing circuit 502 detects tool movement, such as by tilt or vibration.

It will be understood that the control circuit may be implemented in a variety of manners, such as a controller, microcontroller, microprocessor, or digital circuits. In addition, the control circuit and/or motion sensing circuit may be positioned anywhere on or in the tool's housing or within or around the battery and/or battery assembly itself. The present embodiment is used as an example to further understanding and is not intended to limit the present invention to the specific embodiments disclosed herein.

In one embodiment, when the switch 508 is in the active state, a low resistance path to the battery assembly 501 is created. The low resistance path created also enables the battery assembly 501 to power, for example, a trigger switch 514 and/or a head switch 516, enabling activation of the control circuit 512. In the present disclosure, a head switch is a switch that may be selectively turned on or off when the combustion tool is a predetermined orientation, while a trigger switch is a type of switch that may be selectively turned on or off by manipulation or actuation by a user. Head and trigger switches include, but are not limited to optical switches, Hall Effect switches, or mechanical switches. Such switches may be positioned at various positions on the combustion tool, including, but not limited to the trigger, nose, head, housing, and the like.

In a preferred embodiment, either one or both of the head switch and the trigger switch is present in the combustion tool. In one embodiment, in addition to a signal from the motion sensing circuit, the control circuit 512 depends on signals from the head and trigger switches in order to provide a spark for the combustion engine to actuate or fire the tool. When the tool is in active mode, the trigger and head switches are powered and are enabled to signal the control circuit accordingly.

After the period of time has expired, as determined by timer circuit 506, and the timer has not been reset by detection of additional movement or vibration, the switch 508 is turned off and the tool goes into the low power consumption mode. A high resistance path is created from the battery assembly 501 to the switches 514, 516, and the control circuit 512. If the head and trigger 514, 516 switches are not powered, no signal is provided from the head and trigger switches to the control circuit such that the tool cannot be activated. However, when movement is detected, switch 508 begins conducting and the control circuit and the head and trigger switches are powered. The motion sensing circuit enables the tool, almost immediately, to be actuated without any unnecessary priming when motion is sensed. In addition, only minimal current is consumed from the battery assembly when motion is not sensed.

Figure 7:
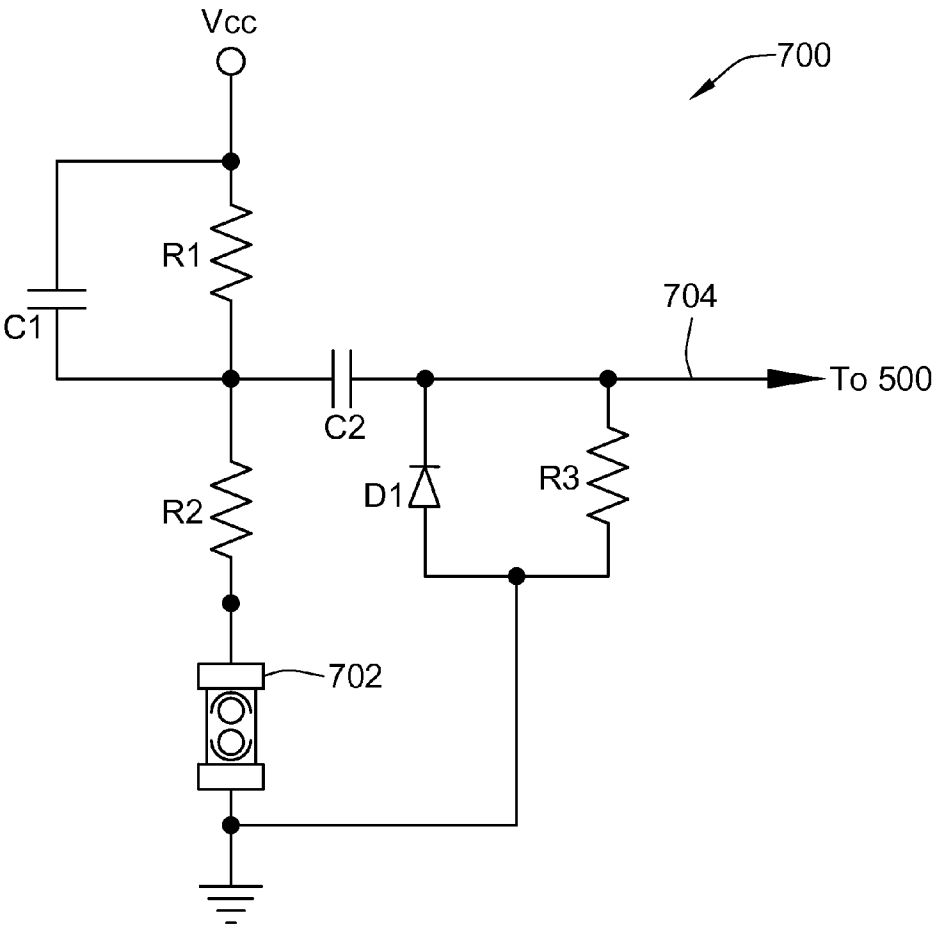
FIG. 7 is another embodiment of the motion sensing circuit for use in the combustion tool.
Figure 6:
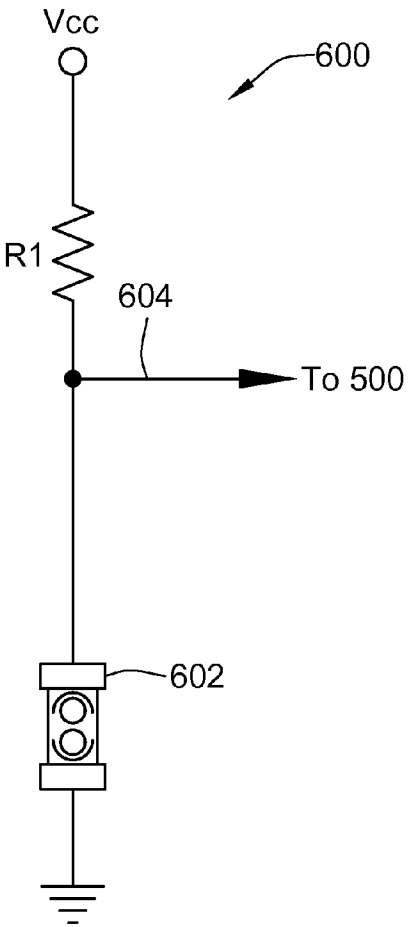
FIG. 6 is an embodiment of the motion sensing circuit for use in the combustion tool.

FIGS. 6 and 7 illustrate examples of various embodiments of the sensing circuit 502 of FIG. 5. The sensing circuits in FIGS. 6 and 7, sensing circuit 600, 700 respectively, in a present embodiment includes a sensor, for example, a SQ-SEN-200 series sensor. In FIG. 6, the battery (Vcc), is connected to the sensor 602 through a single resistor, R1. The output signal, 604 feeds into the control circuit 512 shown in FIG. 5. In another embodiment shown in FIG. 7, the battery (Vcc) is connected to the sensor 702 through a more complex signal filter, and yields an output signal 704 that would also feed into the control circuit 512.

In the examples of the sensing circuit 600, 700, the sensor 602, 702 acts as a normally closed switch which chatters open and closed as it is moved. When at rest, the sensor settles in a normally closed state. When in motion, the sensor 602, 702 will produce continuous on/off contact closures. The sensor 602, 702 is sensitive to both tilt (static acceleration) and vibration (dynamic acceleration). The sensing circuit 600, 700, converts the output signal, 604, 704 from the sensor 602, 702 to an analog signal, such as in FIG. 2, which can be read and used to interrupt (wake up) the tool.

Those skilled in the art will appreciate and understand that the sensing circuits included are examples only and a variety of sensing circuits may be used to produce an output signal for use with the present combustion tool and method to conserve battery power.

The advantages of the present device and method are many. The sensing circuit requires no signal conditioning and draws minimal current. As discussed above, the motion sensing circuit enables the tool, almost immediately, to be actuated without any unnecessary priming when motion is sensed. In addition, only minimal current is consumed from the battery assembly when motion is not sensed, thus conserving battery power.

All patents referred to herein are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A combustion tool having a circuit for conserving battery power comprising:

a battery assembly, the battery assembly configured to power at least a portion of the combustion tool;

a control circuit coupled to the battery that is configured to place the combustion tool in an active mode or a low power consumption mode; and a motion sensing circuit coupled to the control circuit that is configured to indicate a movement of the combustion tool and to indicate a non-movement of the combustion tool to the control circuit, wherein the control circuit is configured to place the combustion tool in the active mode upon the movement of the combustion tool and to place the combustion tool in the low power consumption mode after a period of time after the non-movement of the combustion tool, and wherein the control circuit immediately provides power from the battery to the combustion tool when movement of the combustion tool is detected by the motion sensing circuit.

2. The combustion tool of claim 1 wherein the motion sensing circuit receives power from the battery assembly during low power consumption mode.

3. The combustion tool of claim 1 further comprising a timer circuit, the timer circuit configured to reset each time the motion sensing circuit senses a movement of the tool.

4. The combustion tool of claim 1 wherein the movement is a vibration or a tilt movement.

5. The combustion tool of claim 1 wherein the control circuit is a microprocessor, a microcontroller, or a plurality of digital circuits.

6. The combustion tool of claim 1 wherein at least one of the motion sensing circuit and the control circuit are positioned in the battery assembly.

7. A combustion tool having a circuit for conserving battery power, the combustion tool comprising:

a battery assembly;

a control circuit;

at least one of a first switch and a second switch, the first switch configured to be activated when the combustion tool is in a predetermined position and the second switched configured to be activated by actuation of an operator; and a motion sensing circuit, wherein the control circuit is configured to receive input from the motion sensing circuit and enter into the active state and remain in the active state until a period of time elapses without further input from the motion sensing circuit, wherein the control circuit is configured to enter the low power consumption state to conserve battery power, and wherein when the control circuit is in the active state, the control circuit is enabled to respond to the one of the first switch and the second switch, and wherein when the control circuit is in a low power consumption state, the control circuit is not enabled to respond to the one of the first switch and the second switch, and wherein the control circuit immediately provides power to the tool when movement of the combustion tool is detected.

8. The combustion tool of claim 7 wherein the at least one of the first switch and the second switch is an optical switch, a Hall-effect switch, or a mechanical switch.

9. The combustion tool of claim 7 wherein the motion sensing circuit receives power from the battery assembly during low power consumption mode.

10. The combustion tool of claim 7 further comprising a timer circuit, the timer circuit configured to reset each time the motion sensing circuit senses a movement of the tool.

11. The combustion tool of claim 7 wherein the movement is a vibration or a tilt movement.

* * * * *

UNITED STATES PATENT AND TRADEMARK OFFICE

CERTIFICATE OF CORRECTION

PATENT NO. : 8,261,847 B2
APPLICATION NO. : 12/576949
DATED : September 11, 2012
INVENTOR(S) : Jeffrey C. Ford and Clayton O. Henry It is certified that error appears in the above-identified patent and that said Letters Patent is hereby corrected as shown below:

Column 6, line 16, claim 7, the phrase "and the second switched configured to be activated" should read: "and the second switch configured to be activated".

Signed and Sealed this
Twelfth Day of February, 2013

Teresa Stanek Rea
*Acting Director of the United States Patent and Trademark Office*